US005463155A

United States Patent [19]

Galperin et al.

[11] Patent Number: 5,463,155

[45] Date of Patent: Oct. 31, 1995

[54] UPGRADING OF CYCLIC NAPHTHAS

[75] Inventors: Leonid B. Galperin, Chicago; Jeffery C. Bricker, Buffalo Grove; Jennifer S. Holmgren, Bloomingdale, all of Ill.

[73] Assignee: UOP, Des Plaines, Ill.

[21] Appl. No.: 151,692

[22] Filed: Nov. 15, 1993

[51] Int. Cl.[6] ..... C07C 1/00; C07C 2/00; C07C 5/13

[52] U.S. Cl. ..... 585/310; 585/700; 585/737; 208/65

[58] Field of Search ..... 585/310, 700, 585/737; 208/65

[56] References Cited

U.S. PATENT DOCUMENTS 2,915,571 12/1959 Haensel ..... 260/683.68
3,457,162 7/1969 Riedl et al. ..... 208/143
4,783,575 11/1988 Schmidt et al. ..... 585/748

FOREIGN PATENT DOCUMENTS 2211756 12/1989 United Kingdom ..... 23/42

*Primary Examiner*—Anthony McFarlane
*Assistant Examiner*—Nhat D. Phan
*Attorney, Agent, or Firm*—Thomas K. McBride; John F. Spears, Jr.; Richard E. Conser

[57] ABSTRACT

A process combination is disclosed to selectively upgrade naphtha to obtain an isoparaffin-rich product for blending into gasoline. A naphtha feedstock is subjected to ring cleavage to convert naphthenes to paraffins using a nonacidic catalyst followed by isomerization of paraffins to obtain an increased proportion of isoparaffins.

17 Claims, 1 Drawing Sheet

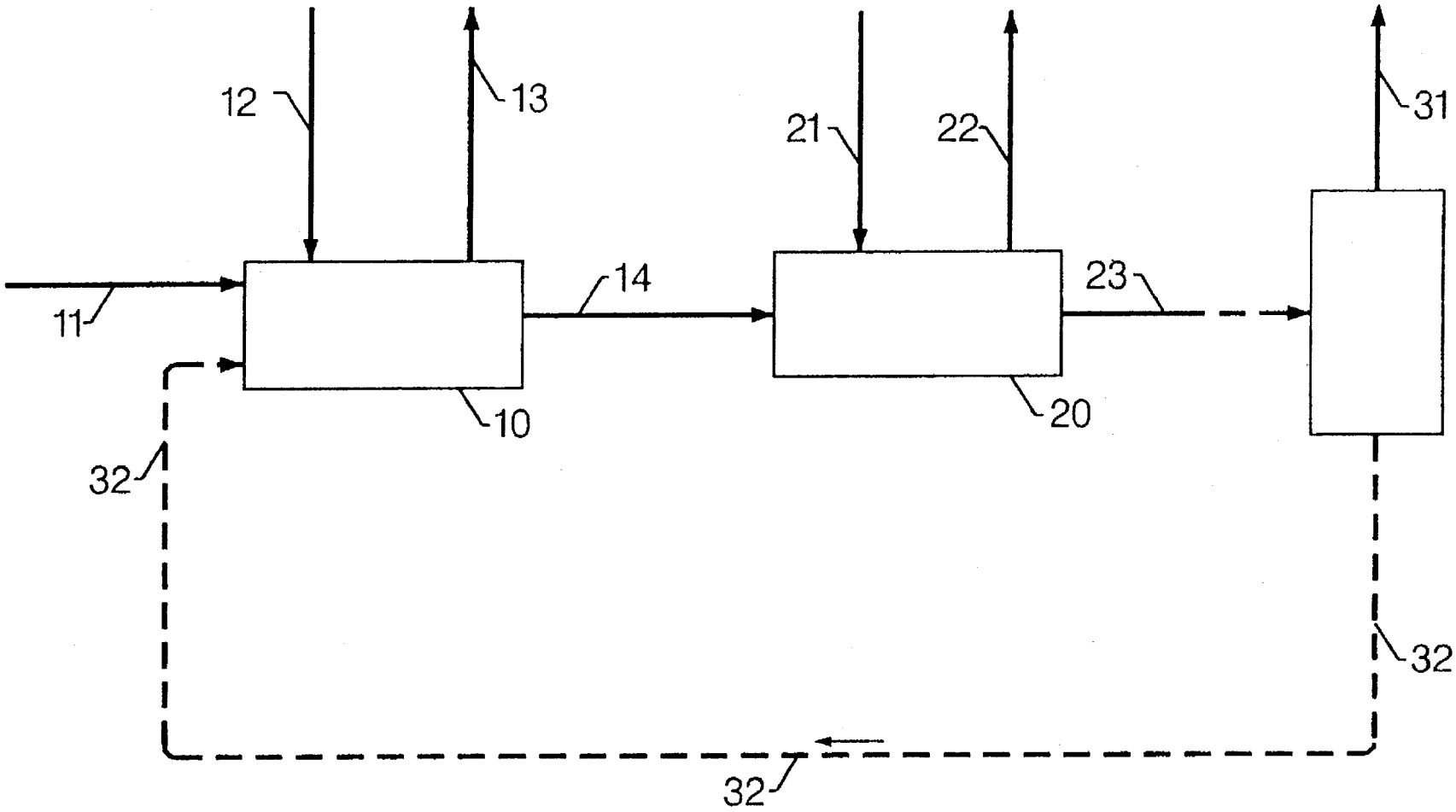
31
32
23
20
22
21
32
14
13
10
12
11
32

UPGRADING OF CYCLIC NAPHTHAS

BACKGROUND OF THE INVENTION

1. Field of the Invention

This invention relates to an improved process combination for the conversion of hydrocarbons, and more specifically for the selective upgrading of naphtha fractions by a combination of ring cleavage and isomerization.

2. General Background

The widespread removal of lead antiknock additive from gasoline and the rising fuel-quality demands of high-performance internal-combustion engines have compelled petroleum refiners to install new and modified processes for increased "octane," or knock resistance, in the gasoline pool. Refiners have relied on a variety of options to upgrade the gasoline pool, including higher-severity catalytic reforming, higher FCC (fluid catalytic cracking) gasoline octane, isomerization of light naphtha and the use of oxygenated compounds. Such key options as increased reforming severity and higher FCC gasoline octane result in a higher aromatics content of the gasoline pool, through the production of high-octane aromatics at the expense of low-octane heavy paraffins.

Currently, refiners are faced with the prospect of supplying reformulated gasoline to meet tightened automotive emission standards. Reformulated gasoline differs from the traditional product in having a lower vapor pressure, lower final boiling point, increased content of oxygenates, and lower content of olefins, benzene and aromatics. Benzene content will be restricted to 1% or lower. Gasoline aromatics content is likely to be lowered into the 20–25% range in major urban areas, and low-emission gasoline containing less than 15 volume % aromatics is being advocated for some areas with severe pollution problems. Distillation end points (usually characterized as the 90% distillation temperature) also could be lowered, further restricting aromatics content since the high-boiling portion of the gasoline which thereby would be eliminated usually is an aromatics concentrate. Since aromatics have been the principal source of increased gasoline octanes during the recent lead-reduction program, severe restriction of the benzene/aromatics content and high-boiling portion will present refiners with processing problems. These problems have been addressed through such technology as isomerization of light naphtha to increase its octane number, isomerization of butanes as alkylation feedstock, and generation of additional light olefins through fluid catalytic cracking and dehydrogenation as feedstock for alkylation and production of oxygenates.

Reduction in gasoline benzene content often has been addressed by changing the cut point between light and heavy naphtha, directing more of the potential benzene formers to isomerization instead of to reforming. No benzene is formed in isomerization, wherein benzene is convened to $C_6$ naphthenes and $C_6$ naphthenes are isomerized toward an equilibrium mixture of cyclohexane and methylcyclopentane or converted to paraffins through ring opening. It is believed that such $C_6$ cyclics are preferentially adsorbed on catalyst sites relative to paraffins, and the cyclics thus have a significant effect on catalyst activity for isomerization of paraffins. Refiners thus face the problem of maintaining the performance of light-naphtha isomerization units which process an increased concentration of feedstock cyclics.

U.S. Pat. No. 4,783,575 (Schmidt et al.) discloses ring opening of at least 40% within an isomerization unit using a high-chloride platinum-alumina catalyst in multiple reaction zones; this approach does not recognize the effect of cyclics conversion on the activity of the acidic isomerization catalyst. U.S. Pat. No. 2,915,571 (Haensel) discloses an isomerization process followed by separation and ring-opening of cyclic hydrocarbons using a supported iron-group-metal catalyst. U.S. Pat. No. 3,457,162 (Riedl et al.) teaches conversion of cyclic hydrocarbons in jet fuel to straight-chain and slightly branched paraffins using a catalyst comprising an inorganic oxide, platinum-group metal and combined chloride; the reaction is carried out at a pressure substantially in excess of 1000 pounds/in$^2$. British specification 2,211,756 (Kellendonk) discloses improvement of jet fuel or diesel properties by hydrodecyclization of naphthenes using a catalyst containing metallic platinum on alumina; ionic platinum is removed from the catalyst by solvent extraction. International patent application WO 93/08145 (Breckenridge et al.) discloses the processing of a hydrocarbon feedstock by ring opening using a zeolitic catalyst followed by isomerization of paraffins; zeolites are characterized by Constraint Index, but there is no teaching relating to zeolite acidity.

SUMMARY OF THE INVENTION

It is an object of the present invention to provide an improved process combination to upgrade naphtha to gasoline. A specific object is to address issues faced by petroleum refiners who are modifying isomerization feedstocks to produce reformulated gasoline.

This invention is based on the discovery that certain nonacidic catalysts are particularly effective for ring cleavage, which, when combined with paraffin isomerization, provides improved gasoline octane values.

A broad embodiment of the present invention is directed to a process using a nonacidic catalyst containing a platinum-group metal to cleave rings in a naphtha feedstock. Preferably ring cleavage is effected prior to isomerization of paraffins in the product of the ring-cleavage step. More preferably, ring cleavage and isomerization are accomplished in the same hydrogen circuit. Optionally, isoparaffin-rich product from isomerization is fractionated to separate a naphthene-rich fraction which is recycled to the ring-cleavage step.

These as well as other objects and embodiments will become apparent from the detailed description of the invention.

BRIEF DESCRIPTION OF THE DRAWINGS

The FIGURE shows a simplified illustration of a flowscheme comprising ring cleavage, isomerization, and separation of a heavy fraction as recycle to ring cleavage.

DESCRIPTION OF THE PREFERRED EMBODIMENTS

The ring-cleavage step of the present invention is observed to be particularly useful in combination with isomerization of light paraffins. By reducing the content of cyclics in the feed to the isomerization step, the proportion of catalyst available for isomerization of paraffins is increased. Within the spirit of the invention, a variety of nonacidic catalysts, process conditions and configurations are effective for opening of rings. Ring cleavage also may be used in conjunction with other processes, e.g., selective isoparaffin synthesis to produce isobutane and other valuable products from middle-range and heavy naphthas. Usually such process combinations are integrated into a petroleum refinery comprising crude-oil distillation, reforming, cracking and other processes known in the art to produce finished gasoline and other petroleum products.

Although ring cleavage may be used in combination with other processes, ring cleavage and isomerization preferably are combined as shown in the FIGURE. This diagram provides an overview of the process, which also comprises appurtenances such as heat exchangers, pumps, compressors and instruments known to those of ordinary skill in the art. The naphtha feedstock is charged via line 11, along with hydrogen via line 12, to the ring-cleavage zone 10 which opens naphthenic rings at ring-cleavage conditions over a ring-cleavage catalyst to produce a paraffinic intermediate in line 14. Light gases produced in the ring-cleavage zone may either be removed via line 13 if the ring-cleavage and subsequent isomerization zones have separate hydrogen circuits or passed into the isomerization zone in combination with the paraffinic intermediate if the two zones are contained in a single hydrogen circuit.

The paraffinic intermediate is transferred via line 14 to a isomerization zone 20 which preferably is contained within the same hydrogen circuit as the ring-cleavage zone, i.e., hydrogen and light hydrocarbons are not separated from the paraffinic intermediate before entering the isomerization zone. This single circuit obviates the need for two sets of heat exchangers, separators and compressors for hydrogen-rich gas. The paraffinic intermediate thus also may be transferred to the isomerization zone at an increased temperature resulting from the exothermic heat of reaction of ring opening and aromatics hydrogenation. In this manner, heating of the paraffinic intermediate optimally is not required. In the isomerization zone 20 the paraffinic intermediate is converted to yield more-highly-branched paraffins at isomerization conditions over a selective solid acid isomerization catalyst. Small amounts of light gases are separated by flash and/or fractionation and removed via line 22, and an isoparaffin-rich product is obtained via line 23.

The product optionally passes to fractionator 30 which separates an isoparaffin concentrate via 31. In this case, a cyclics concentrate is removed from near or at the bottom of the fractionator via line 32 and recycled to the ring-cleavage zone. It is within the scope of the invention that the feedstock passes directly to isomerization via line 14, with the total feed to ring cleavage being the cyclics concentrate in line 32.

Naphtha feedstock to the present process comprises paraffins, naphthenes, and aromatics, and may comprise small amounts of olefins, boiling within the gasoline range. Feedstocks which may be utilized include straight-run naphthas, natural gasoline, synthetic naphthas, thermal gasoline, catalytically cracked gasoline, partially reformed naphthas or raffinates from extraction of aromatics. The feedstock essentially is encompassed by the range of a full-range naphtha, or within the range of 0° to 230° C. Usually the feedstock is light naphtha having an initial boiling point of about 10° to 65° C. and a final boiling point from about 75° to 110° C.; preferably, the final boiling point is less than about 95° C.

The naphtha feedstock generally contains small amounts of sulfur compounds amounting to less than 10 mass parts per million (ppm) on an elemental basis. Preferably the naphtha feedstock has been prepared from a contaminated feedstock by a conventional pretreating step such as hydrotreating, hydrorefining or hydrodesulfurization to convert such contaminants as sulfurous, nitrogenous and oxygenated compounds to $H_2S$, $NH_3$ and $H_2O$, respectively, which can be separated from hydrocarbons by fractionation. This conversion preferably will employ a catalyst known to the art comprising an inorganic oxide support and metals selected from Groups VIB(6) and VIII(9–10) of the Periodic Table. [See Cotton and Wilkinson, *Advanced Inorganic Chemistry,* John Wiley & Sons (Fifth Edition, 1988)]. Preferably, the pretreating step will provide the process combination with a hydrocarbon feedstock having low sulfur levels disclosed in the prior art as desirable, e.g., 1 mass ppm to 0.1 ppm (100 ppb). It is within the are bit of the present invention that this optional pretreating step be included in the present process combination.

The principal components of the preferred feedstock are alkanes and cycloalkanes having from 4 to 7 carbon atoms per molecule ($C_4$ to $C_7$), especially $C_5$ to $C_6$, and smaller amounts of aromatic and olefinic hydrocarbons also may be present. Usually, the concentration of $C_7$ and heavier components is less than about 20 mass % of the feedstock. Although there are no specific limits to the total content in the feedstock of cyclic hydrocarbons, the feedstock generally contains between about 2 and 40 mass % of cyclics comprising naphthenes and aromatics.

The aromatics contained in the naphtha feedstock, although generally amounting to less than the alkanes and cycloalkanes, may comprise from 2 to 20 mass % and more usually 5 to 10 mass % of the total. Benzene usually comprises the principal aromatics constituent of the preferred feedstock, optionally along with smaller amounts of toluene and higher-boiling aromatics within the boiling ranges described above. The aromatics generally are not hydrogenated to naphthenes to a large extent in a naphtha pretreating process as described above, and thus mostly remain in the feed to the ring-cleavage step. Since aromatics in the feed to an isomerization process are essentially quantitatively hydrogenated, the resulting exothermic heat of reaction can affect the temperature profile of the isomerization to a significant extent. Most or substantially all of the aromatics are beneficially hydrogenated in conjunction with the ring-opening reaction, prior to isomerization in the ring-cleavage zone of the present invention, thus enabling more precise control of isomerization temperature.

Naphtha feedstock and hydrogen comprise combined feed to the ring-cleavage zone, which contains a nonacidic ring-cleavage catalyst and operates at suitable conditions to open naphthenic rings to form paraffins without a high degree of conversion to lighter products. The ring-cleavage catalyst comprises one or more platinum-group metals, selected from the group consisting of platinum, palladium, ruthenium, rhodium, osmium, and iridium, on a nonacidic support comprising one or more of a refractory inorganic-oxide and a large-pore molecular sieve. The "nonacidic support" has a substantial absence of acid sites, for example as an inherent property or through ion exchange with one or more basic cations.

The nonacidity of the ring-cleavage support may be determined using a variety of methods known in the art. A preferred method of determining acidity is the heptene cracking test as described below. Conversion of heptene, principally by cracking, isomerization and ring formation, is measured at specified conditions. Cracking is particularly indicative of the presence of strong acid sites. A nonacidic catalyst suitable for ring cleavage demonstrates low conversion and particularly low cracking in the heptene test: conversion generally is less than 30% and cracking less than about 5%. The best supports demonstrate no more than about 5% conversion and negligible cracking.

The heptene cracking test also is effected in an atmospheric microreactor. In this test procedure an electrically heated reactor is loaded with 250 mg of 40–60 mesh particles made by crushing the sample particles. Each catalyst is dried in situ for 30 minutes at 200° C. using flowing hydrogen. The catalyst is then subjected to a reduction treatment for one hour at 550° C. in flowing hydrogen.

The reactor is then brought to the desired operational temperature of 425° C. (inlet). The feed stream to the reactor comprises hydrogen gas saturated with 1-heptene at 0° C. and ambient atmospheric pressure. The inlet temperature is held constant while the flow rate of the 1-heptene saturated hydrogen is varied in a predetermined pattern. Analysis is performed by analyzing the effluent using a gas chromatograph. Samples for analysis are automatically taken after 15 minutes of onstream operation at 250 cc/min. feed gas flow, at 45 minutes with the feed flowrate at 500 cc/min., at 75 minutes with the feed gas flowrate at 1000 cc/min., at 105 minutes with the feed gas flowrate at 125 cc/min. and after 135 minutes with the feed gas flowrate at the initial 250 cc/min. In each instance the feed gas flowrate is adjusted after the previous sample is taken. The analytical results are reported at each elapsed time during the test in weight percent indicating the composition of the effluent stream.

Alternatively, nonacidity may be characterized by the ACAC (acetonylacetone) test. ACAC is converted over the support to be tested at specified conditions: dimethylfuran in the product is an indicator of acidity, while methylcyclopentenone indicates basicity. Conversion over the support of the invention during a 5-minute period at 150° C. at a rate of 100 cc/min should yield less than 5 mass %, and preferably less than 1%, acid products. Conversion to basic products can usefully be in the range of 0–70 mass %.

Another useful method of measuring acidity is $NH_3$-TPD (temperature-programmed desorption) as disclosed in U.S. Pat. No. 4,894,142, incorporated herein by reference; the $NH_3$-TPD acidity strength should be less than about 1.0. Other methods such as $^{31}P$ solids NMR of adsorbed TMP (trimethylphosphine) also may be used to measure acidity.

The preferred nonacidic support optimally comprises a porous, adsorptive, high-surface-area inorganic oxide having a surface area of about 25 to about 500 $m^2/g$. The porous support should also be uniform in composition and relatively refractory to the conditions utilized in the process. By the term "uniform in composition," it is meant that the support be unlayered, has no concentration gradients of the species inherent to its composition, and is completely homogeneous in composition. Thus, if the support is a mixture of two or more refractory materials, the relative amounts of these materials will be constant and uniform throughout the entire support. It is intended to include within the scope of the present invention refractory inorganic oxides such as alumina, titania, zirconia, chromia, zinc oxide, magnesia, thoria, boria, silica-alumina, silica-magnesia, chromia-alumina, alumina-boria, silica-zirconia and other mixtures thereof.

The preferred refractory inorganic oxide for use in the present invention comprises alumina. Suitable alumina materials are the crystalline aluminas known as the theta-, alpha-, gamma-, and eta-alumina, with theta-, alpha-, and gamma-alumina giving best results. Magnesia, alone or in combination with alumina, comprises an alternative inorganic-oxide component of the catalyst and provides the required nonacidity. The preferred refractory inorganic oxide will have an apparent bulk density of about 0.3 to about 1.1 g/cc and surface area characteristics such that the average pore diameter is about 20 to 1000 angstroms, the pore volume is about 0.05 to about 1 cc/g, and the surface area is about 50 to about 500 $m^2/g$.

The inorganic-oxide powder may be formed into a suitable catalyst material according to any of the techniques known to those skilled in the catalyst-carrier-forming art. Spherical carrier particles may be formed, for example, from the preferred alumina by: (1) converting the alumina powder into an alumina sol by reaction with a suitable peptizing acid and water and thereafter dropping a mixture of the resulting sol and a gelling agent into an oil bath to form spherical particles of an alumina gel which are easily converted to a gamma-alumina support by known methods; (2) forming an extrudate from the powder by established methods and thereafter rolling the extrudate particles on a spinning disk until spherical particles are formed which can then be dried and calcined to form the desired particles of spherical support; and (3) wetting the powder with a suitable peptizing agent and thereafter rolling the particles of the powder into spherical masses of the desired size. The powder can also be formed in any other desired shape or type of support known to those skilled in the art such as rods, pills, pellets, tablets, granules, extrudates, and like forms by methods well known to the practitioners of the catalyst material forming art.

The preferred form of carrier material for the ring-cleavage catalyst is a cylindrical extrudate. The extrudate particle is optimally prepared by mixing the preferred alumina powder with water and suitable peptizing agents such as nitric acid, acetic acid, aluminum nitrate, and the like material until an extrudable dough is formed. The amount of water added to form the dough is typically sufficient to give a Loss on Ignition (LOI) at 500° C. of about 45 to 65 mass %, with a value of 55 mass % being especially preferred. The resulting dough is then extruded through a suitably sized die to form extrudate particles.

The extrudate particles are dried at a temperature of about 150° to 200° C., and then calcined at a temperature of about 450° to 800° C. for a period of 0.5 to 10 hours to effect the preferred form of the refractory inorganic oxide.

It is essential that the catalyst be non-acidic, as acidity in the zeolite lowers the selectivity to paraffins of the finished catalyst. The required nonacidity may be effected by any suitable method, including impregnation, co-impregnation with a platinum-group metal, or ion exchange. Impregnation of one or more of the alkali and alkaline earth metals, especially potassium, in a salt solution is favored as being an economically attractive method. The metal effectively is associated with an anion such as hydroxide, nitrate or a halide such as chloride or bromide consistent with nonacidity of the finished catalyst, with a nitrate being favored. Optimally, the support is cold-rolled with an excess of solution in a rotary evaporator in an amount sufficient to provide a nonacidic catalyst. The alkali or alkaline earth metal may be coimpregnated along with a platinum-group metal component, as long as the platinum-group metal does not precipitate in the presence of the salt of the alkali or alkaline earth metal.

Ion exchange is an alternative method of incorporating nonacidity into the catalyst. The inorganic-oxide support is contacted with a solution containing an excess of metal ions over the amount needed to effect nonacidity. Although any suitable method of contacting may be used, an effective method is to circulate a salt solution over the support in a fixed-bed loading tank. A water-soluble metal salt of an alkali or alkaline earth metal is used to provide the required metal ions; a potassium salt is particularly preferred. The support is contacted with the solution suitably at a temperature ranging from about 10° to about 100° C.

An alternative suitable support having inherent nonacidity may be termed a "synthetic hydrotalcite" characterized as a layered double hydroxide or metal-oxide solid solution. Hydrotalcite is a clay with the ideal unit cell formula of $Mg_6Al_2(OH)_{16}(CO_3).4H_2O$, and closely related analogs with variable magnesium/aluminum ratios may be readily prepared. W. T. Reichle has described in the *Journal of Catalysis*, 94, 547–557 (1985), the synthesis and catalytic use of such synthetic hydrotalcites, including materials having Mg and Al replaced by other metals. Calcination of such layered double hydroxides results in destruction of the layered structure and formation of materials which are effectively described as solid solutions of the resulting metal oxides.

These embodiments of the present support are disclosed in copending application Ser. No. 987,838, incorporated by reference, and are solid solutions of a divalent metal oxide and a trivalent metal oxide having the general formula $(M^{+2}{}_xO)(M^{+3}{}_yO)OH_y$ derived by calcination of synthetic hydrotalcite-like materials whose general formula may be expressed as $(M^2)_x(M^{+3})_y(OH)_zA_q.rH2O$. $M^{+2}$ is divalent metal or combination of divalent metals selected from the group consisting of magnesium, calcium, barium, nickel, cobalt, iron, copper and zinc. $M^{+3}$ is a trivalent metal or combination of trivalent metals selected from the group consisting of aluminum, gallium, chromium, iron, and lanthanum. Both $M^{+2}$ and $M^{+3}$ may be mixtures of metals belonging to the respective class: for example, $M^{+2}$ may be pure nickel or may be both nickel and magnesium, or even nickel-magnesium-colbalt; $M^{+3}$ may be solely aluminum or a mixture of aluminum and chromium, or even a mixture of three trivalent metals such as aluminum, chromium, and gallium. $A_q$ is an anion, most usually carbonate although other anions may be employed equivalently, especially anions such as nitrate, sulfate, chloride, bromide, hydroxide, and chromate. The case where $M^{+2}$ is magnesium, $M^{+3}$ is aluminum, and A is carbonate corresponds to the hydrotalcite series.

It is preferable that the $(M^{+2}{}_xO)(M^{+3}{}_yO)OH_y$ solid solution has a surface area at least about 150 $m^2/g$, more preferably at least 200 $m^2/g$ and it is even more preferable that it be in the range from 300 to 350 $m^2/g$. The ratio x/y of the divalent and trivalent metals can vary between about 2 and about 20, with the ratios of 2 to about 10 being preferred.

Preparation of suitable basic metal-oxide supports is described in detail in the referenced copending application Ser. No. 987,838. Precursor gel is prepared at a temperature not exceeding about 10° C., and preferably is prepared in the temperature interval between about 0° and 5° C. In addition, the crystallization time is kept short, on the order of an hour or two at 65° C., to afford layered double hydroxides whose calcination leads to materials of unusual hydrothermal stability. Calcination of the layered double hydroxide is effected at temperatures between about 400° and about 750° C. Unusual stability and homogeneity is evidenced by the fact that spinel formation is not seen until calcination temperatures of about 800° C., whereas the spinel phase begins to appear in prior-art hydrotalcite-type layered double hydroxides at a calcination temperature of about 600° C.

In the above embodiments of the ring-cleavage catalyst composition comprising an inorganic-oxide support, the catalyst favorably is substantially free of microcrystalline porous material, i.e., a molecular sieve, and in particular is substantially zeolite-free. In yet another alternative embodiment, however, the ring-cleavage catalyst contains a non-acidic large-pore molecular sieve, an alkali-metal component and a platinum-group metal component.

It is essential that the molecular sieve of this alternative embodiment be non-acidic, as acidity in the sieve lowers the selectivity for ring cleavage of the finished catalyst. In order to be "non-acidic," the sieve has substantially all of its cationic exchange sites occupied by nonhydrogen species. Preferably the cations occupying the exchangeable cation sites will comprise one or more of the alkali metals, although other cationic species may be present. An especially preferred nonacidic large-pore molecular sieve is potassium-form L-zeolite.

Generally the large-pore molecular sieve is composited with a binder in order to provide a convenient form for use in the catalyst of the present invention. The art teaches that any refractory inorganic oxide binder is suitable. One or more of silica, alumina or magnesia are preferred binder materials of the present invention. Amorphous silica is especially preferred, and excellent results are obtained when using a synthetic white silica powder precipitated as ultrafine spherical particles from a water solution. The silica binder preferably is nonacidic, contains less than 0.3 mass % sulfate salts, and has a BET surface area of from about 120 to 160 $m^2/g$.

The large-pore molecular sieve and binder may be composited to form the desired catalyst shape by any method known in the art. For example, the preferred potassium-form L-zeolite and amorphous silica may be commingled as a uniform powder blend prior to introduction of a peptizing agent. An aqueous solution comprising sodium hydroxide is added to form an extrudable dough. The dough preferably will have a moisture content of from 30 to 50 mass % in order to form extrudates having acceptable integrity to withstand direct calcination. The resulting dough is extruded through a suitably shaped and sized die to form extrudate particles, which are dried and calcined by known methods. Alternatively, spherical particles may be formed by methods described hereinabove for the inorganic-oxide ring-cleavage catalyst.

An alkali-metal component is an optional constituent of the sieve-containing ring-cleavage catalyst. One or more of the alkali metals, including lithium, sodium, potassium, rubidium, cesium and mixtures thereof, may be used, with potassium being preferred. The alkali metal optimally will occupy essentially all of the cationic exchangeable sites of the non-acidic large-pore molecular sieve. Surface-deposited alkali metal also may be present as described in U.S. Pat. No. 4,619,906, incorporated herein in by reference thereto.

The platinum-group metal component, comprising one or more of a platinum, palladium, rhodium, ruthenium, iridium or osmium component with a platinum component being preferred, is another essential feature of the ring-cleavage catalysts. This metal component may exist within the catalyst as a compound such as the oxide, sulfide, halide, or oxyhalide, in chemical combination with one or more other ingredients of the catalytic composite, or as an elemental metal. Best results are obtained when substantially all of the metal exists in the catalytic composite in a reduced state. The platinum-group metal component generally comprises from about 0.05 to 5 mass % of the catalytic composite, preferably 0.05 to 2 mass %, calculated on an elemental basis.

The platinum-group metal component may be incorporated into the isomerization catalyst in any suitable manner such as coprecipitation or cogellation with the carrier material, ion exchange or impregnation. Impregnation using water-soluble compounds of the metal is preferred. Typical platinum-group compounds which may be employed are chloroplatinic acid, ammonium chloroplatinate, bromoplatinic acid, platinum dichloride, platinum tetrachloride hydrate, tetraamine platinum chloride, tetraamine platinum nitrate, platinum dichlorocarbonyl dichloride, dinitrodiaminoplatinum, palladium chloride, palladium chloride dihydrate, palladium nitrate, etc. Chloroplatinic acid or tetraamine platinum chloride are preferred as the source of the preferred platinum component.

It is within the scope of the present invention that the catalyst may contain supplemental metal components known to modify the effect of the preferred platinum component. Such metal modifiers may include Group IVA(14) metals, other Group VII1(8–10) metals, rhenium, indium, gallium, bismuth, zinc, uranium, dysprosium, thallium and mixtures thereof. One or more of rhenium, germanium, tin, lead, gallium, indium and bismuth are preferred modifier metals. Catalytically effective amounts of such metal modifiers may be incorporated into the catalyst by any means known in the art.

The final ring-cleavage catalyst generally will be dried at a temperature of from about 100° to 320° C. for about 0.5 to 24 hours, followed by oxidation at a temperature of about 300° to 550° C. in an air atmosphere which preferably contains a chlorine component for 0.5 to 10 hours. Preferably the oxidized catalyst is subjected to a substantially water-free reduction step at a temperature of about 300° to 550° C. for 0.5 to 10 hours or more. The duration of the reduction step should be only as long as necessary to reduce the platinum, in order to avoid pre-deactivation of the catalyst, and may be performed in-situ as part of the plant startup if a dry atmosphere is maintained.

The above catalysts have been found to provide satisfactory cleavage of rings in a naphtha feedstock at conditions including temperatures within the range of from about 100° to 550° C. and preferably 200° to 450° C., with higher temperatures being more appropriate for feedstocks with higher cyclics contents and lower temperatures favoring saturation of aromatic compounds in the feed. Operating pressures range from about 100 kPa to 10 MPa absolute, preferably between about 0.5 and 4 MPa. Hydrogen to hydrocarbon molar ratios relative to the feedstock are in the range of about 0.1 to 100, preferably between about 0.5 and 10. Liquid hourly space velocities (LHSV) range from about 0.1 to 30, and optimally are in the range of about 0.5 to 10.

The paraffinic intermediate from the ring-cleavage zone has a low cyclics content, relative to the naphtha feedstock. At least about 50%, preferably at least about 60%, and more advantageously about 70% or more of the naphthenes in the feedstock are converted in the ring-cleavage zone by selective ring opening according to the invention to form principally paraffins having the same carbon number as the converted naphthenes. Ring-cleavage selectivity, expressed as mass % yield of paraffins having the same carbon number as the naphthenes converted, is at least about 90% and preferably about 95% or more. Aromatics in the feedstock which have been saturated in the ring-cleavage zone to form naphthenes are converted to paraffins to a similar extent. Through saturation with hydrogen, the aromatics content generally is reduced about 90% or more relative to that of the naphtha feedstock; usually the aromatics content will be less than about 0.1 mass %, and often in the region of about 100 mass ppm or less, although such low levels are not critical to the utility of the process combination.

Although hydrogen and light hydrocarbons may be removed by flash separation and/or fractionation from the paraffinic intermediate between the ring-cleavage zone and the isomerization zone, the intermediate preferably is transferred between zones without separation of hydrogen or light hydrocarbons. The exothermic saturation reaction provides a heated, paraffinic intermediate to the isomerization zone which generally requires no further heating to effect the required isomerization temperature. A cooler or other heat exchanger between the ring-cleavage zone and isomerization zone may be appropriate for temperature flexibility or for the startup of the process combination.

Contacting within the ring-cleavage and isomerization zones may be effected using the catalyst in a fixed-bed system, a moving-bed system, a fluidized-bed system, or in a batch-type operation. A fixed-bed system is preferred. The reactants may be contacted with the bed of catalyst particles in either upward, downward, or radial-flow fashion. The reactants may be in the liquid phase, a mixed liquid-vapor phase, or a vapor phase when contacted with the catalyst particles, with excellent results being obtained by application of the present invention to a primarily liquid-phase operation. The isomerization zone may be in a single reactor or in two or more separate reactors with suitable means therebetween to insure that the desired isomerization temperature is maintained at the entrance to each zone. Two or more reactors in sequence are preferred to enable improved isomerization through control of individual reactor temperatures and for partial catalyst replacement without a process shutdown.

Isomerization conditions in the isomerization zone include reactor temperatures usually ranging from about 40° to 250° C. Lower reaction temperatures are generally preferred in order to favor equilibrium mixtures having the highest concentration of high-octane highly branched isoalkanes and to minimize cracking of the feed to lighter hydrocarbons. Temperatures in the range of from about 40° to about 150° C. are preferred in the present invention. Reactor operating pressures generally range from about 100 kPa to 10 MPa absolute, preferably between about 0.5 and 4 MPa. Liquid hourly space velocities range from about 0.2 to about 15 volumes of isomerizable hydrocarbon feed per hour per volume of catalyst, with a range of about 0.5 to 5 $hr^{-1}$ being preferred.

Hydrogen is admixed with or remains with the paraffinic intermediate to the isomerization zone to provide a mole ratio of hydrogen to hydrocarbon feed of about 0.01 to 5. The hydrogen may be supplied totally from outside the process or supplemented by hydrogen recycled to the feed after separation from reactor effluent. Light hydrocarbons and small amounts of inerts such as nitrogen and argon may be present in the hydrogen. Water should be removed from hydrogen supplied from outside the process, preferably by an adsorption system as is known in the art. In a preferred embodiment the hydrogen to hydrocarbon mol ratio in the reactor effluent is equal to or less than 0.05, generally obviating the need to recycle hydrogen from the reactor effluent to the feed.

Water and sulfur are catalyst poisons especially for the chlorided platinum-alumina catalyst composition described hereinbelow. Water can act to permanently deactivate the catalyst by removing high-activity chloride from the catalyst, and sulfur temporarily deactivates the catalyst by platinum poisoning. Feedstock hydrotreating as described hereinabove usually reduces water-generating oxygenates to the required 0.1 ppm or less and sulfur to 0.5 ppm or less. Other means such as adsorption systems for the removal of sulfur and water from hydrocarbon streams are well known to those skilled in the art.

Any catalyst known in the art to be suitable for the isomerization of paraffin-rich hydrocarbon streams may be used as an isomerization catalyst in the isomerization zone. One suitable isomerization catalyst comprises a platinum-group metal, hydrogen-form crystalline aluminosilicate and a refractory inorganic oxide, and the composition preferably has a surface area of at least 580 $m^2/g$. The preferred noble metal is platinum which is present in an amount of from about 0.01 to 5 mass % of the composition, and optimally from about 0.15 to 0.5 mass %. Catalytically effective amounts of one or more promoter metals preferably selected from Groups VIB(6), VIII(8–10), IIB(11), IIB(12), IVA(14), rhenium, iron, cobalt, nickel, gallium and indium also may be present. The crystalline aluminosilicate may be synthetic or naturally occurring, and preferably is selected from the group consisting of FAU, LTL, MAZ and MOR with mordenite having a silica-to-alumina ratio of from 16:1 to 60:1 being especially preferred. The crystalline aluminosilicate generally comprises from about 50 to 99.5 mass % of the composition, with the balance being the refractory inorganic oxide. Alumina, and preferably one or more of gamma-alumina and eta-alumina, is the preferred inorganic oxide. Further details of the composition are disclosed in U.S. Pat. No. 4,735,929, incorporated herein by reference thereto.

A preferred isomerization catalyst composition comprises one or more platinum-group metals, a halogen, and an inorganic-oxide binder. Preferably the catalyst contains a Friedel-Crafts metal halide, with aluminum chloride being especially preferred. The optimal platinum-group metal is platinum which is present in an amount of from about 0.1 to 5 mass %. The inorganic oxide preferably comprises alumina, with one or more of gamma-alumina and eta-alumina providing best results. Optimally, the carrier material is in the form of a calcined cylindrical extrudate. The composition may also contain an organic polyhalo component, with carbon tetrachloride being preferred, and the total chloride content is from about 2 to 15 mass %. An organic-chloride promoter, preferably carbon tetrachloride, is added during operation to maintain a concentration of 30 to 300 mass ppm of promoter in the combined feed. Other details and alternatives of preparation steps and operation of the preferred isomerization catalyst are as disclosed in U.S. Pat. Nos. 2,999,074 and 3,031,419 which are incorporated herein by reference.

The isomerization zone generally comprises a separation section, optimally comprising one or more fractional distillation columns having associated appurtenances and separating lighter components from an isoparaffin-rich product. In addition, as discussed hereinabove in connection with the FIGURE, a fractionator may separate an isoparaffin concentrate from a cyclics concentrate with the latter being recycled to the ring-cleavage zone.

Preferably part or all of the isoparaffin-rich product and/or the isoparaffin concentrate are blended into finished gasoline along with other gasoline components from refinery processing including but not limited to one or more of butanes, butenes, pentanes, naphtha, catalytic reformate, isomerate, alkylate, polymer, aromatic extract, heavy aromatics; gasoline from catalytic cracking, hydrocracking, thermal cracking, thermal reforming, steam pyrolysis and coking; oxygenates such as methanol, ethanol, propanol, isopropanol, TBA, SBA, MTBE, ETBE, MTAE and higher alcohols and ethers; and small amounts of additives to promote gasoline stability and uniformity, avoid corrosion and weather problems, maintain a clean engine and improve driveability.

EXAMPLES

The following examples serve to illustrate certain specific embodiments of the present invention. These examples should not, however, be construed as limiting the scope of the invention as set forth in the claims. There are many possible other variations, as those of ordinary skill in the art will recognize, which are within the spirit of the invention.

EXAMPLE 1

The benefits of using the process combination of the invention are illustrated by contrasting results with those from a corresponding process of the prior art. A series of acidic catalysts of the prior art were tested to determine their selectivity for naphthene ring opening in comparison to the principal competing reactions of dehydrogenation to aromatics and cracking to lighter products.

The following acidic catalysts, containing platinum as indicated, were prepared and impregnated with platinum as taught in the references:

| Catalyst | Description | Pt. Mass % | U.S. Pat. No. |
|---|---|---|---|
| A | mordenite | 0.3 | 4,735,929 |
| B | Y zeolite | 0.3 | 5,013,699 |
| C | MFI | 0.3 | 3,702.886 |
| D | SAPO-11 | 0.3 | 4,440,871 |
| E | Beta zeolite | 0.3 | 5,116,794; Re 28,341 |
| F | Omega zeolite | 0.3 | 5,139,761; 4,241,036 |
| G | Alumina, Cl, Sn | 0.375 | 3,702,294 |
| H | Alumina, Cl | 0.375 | 2,479,110 |

EXAMPLE 2

The acidic catalysts described in Example 1 were microreactor-tested for efficiency in ring cleavage. The feed was substantially pure methylcyclopentane, and the tests were performed at a temperature of 350° C., a hydrogen/hydrocarbon mol ratio of 60, and a liquid hourly space velocity of 2.0. At the specified conversions, ring-cleavage selectivity was measured as mass % yield of paraffins, dehydrogenation selectivity as mass % aromatics, and cracking selectivity as mass % $C_1$–$C_5$ hydrocarbons:

| Catalyst | Conversion | Cleavage | Dehydro. | Cracking |
|---|---|---|---|---|
| A | 46.0 | 6.7 | 72.0 | 5.4 |
| B | 13.7 | 8.7 | 55.9 | 2.3 |
| C | 21.7 | 26.1 | 50.5 | 8.9 |
| D | 5.3 | 42.4 | 46.4 | 1.0 |
| E | 58.4 | 2.8 | 90.5 | 1.0 |
| F | 15.9 | 2.0 | 65.9 | 2.0 |
| G | 1.5 | 68.0 | 25.1 | 1.4 |
| H | 18.8 | 69.0 | 18.8 | 3.4 |

The prior-art catalysts generally showed high selectivity to aromatics rather than the desired ring cleavage. The most effective catalysts, G and H, operated at less than 20% conversion and achieved less than 70% selectivity for ring opening.

EXAMPLE 3

A catalyst was prepared by the impregnation of hydrotalcite to compare ring-cleavage performance against acidic catalysts of the prior art.

A 2 L, 3-necked round bottomed flask was equipped with an addition funnel, a thermometer, a mechanical stirrer, and a heating mantle. To this flask was added a solution containing 610 g of water, 60 g of $Na_2CO_3.H_2O$ and 71 g of NaOH and the contents were cooled to, 5° C. The addition funnel was charged with a solution of 345 g water, 77 g $Mg(NO_3)_2.6H_2O$ and 75 g $Al(NO_3)_3.9H_2O$ and this solution was added over a period of 4 hours. The solution temperature was maintained at, 5° C. throughout the addition and the resulting slurry was stirred for 1 hour at, 5° C. The addition funnel was replaced by a reflux condenser and the slurry was heated to 600°±5° C. for 1 hour. The slurry was then cooled to room temperature and the solids recovered by filtration. The solids were washed with 10 L of hot deionized water. The solids were then dried at 100° C. for 16 hours and this product was characterized as hydrotalcite by its x-ray diffraction (XRD) pattern. After crushing, the solid was calcined at 450° C. for 12 hours in a muffle furnace with an air flow. This product was characterized as a $MgO-Al_2O_3$ solid solution (Mg/Al=1.5) by XRD. The BET surface area for this material was 285 $m^2g$.

Catalyst X was prepared using organic Pt impregnation. The aforementioned solid solution in an amount of 42.6 g was impregnated with 1.246 g of Pt-ethylhexanoate in 50 cc acetone. After mixing support and solution for 3 hours the excess of acetone was evaporated and catalyst was dried at 200° C. in 3600 cc/hr air for 3 hours and reduced with $H_2$ for 2 hours. The finished catalyst contained 0.75% Pt.

EXAMPLE 4

Two nonacidic aluminas of invention were prepared by the addition of K to compare ring-cleavage performance with acidic catalysts of the prior art.

Catalyst Y was prepared by the impregnation of 77.4 g gamma alumina with 120 cc water solution of 1.24 g $Pt(NH_3)_4C_{12}$, as above 3.05 g $KNO_3$ and 2.2 g $HNO_3$ in the rotary evaporator. After 2 hours of cold roll and excess of solution was evaporated for 2 hours and catalyst calcined and reduced as X-1 in Example 3. The finished catalyst contained 0.9% Pt and 1.5% K and had a B-E-T surface area of 180 $m^2/g$.

Catalyst Z was prepared following the same procedure as catalyst Y but 59 g of theta alumina were impregnated with 0.525 g $Pt(NH_3)_4C_{12}$ and 0.437 g of $KNO_3$. The finished catalyst contained 0.9% Pt and 0.79% K and had a B-E-T surface area of 80 $m^2/g$.

EXAMPLE 5

Catalysts X, Y and Z of the invention were tested for efficiency in ring cleavage in the manner described in Example 2 for acidic catalysts of the prior art. The feed was substantially pure methylcyclopentane, and the tests were performed at a temperature of 350° C., a hydrogen/hydrocarbon mol ratio of 60, and a liquid hourly space velocity of 2.0. At the specified conversions, ring-cleavage selectivity was measured as mass % yield of paraffins having the same carbon number, dehydrogenation selectivity as mass % aromatics, and cracking selectivity as mass % $C_1$–$C_5$ hydrocarbons:

| Catalyst | Conversion | Cleavage | Dehydro. | Cracking |
|---|---|---|---|---|
| X | 60.9 | 96.5 | 0.7 | 1.6 |
| Y | 68.5 | 98.6 | 0.5 | 0.9 |

-continued

| Catalyst | Conversion | Cleavage | Dehydro. | Cracking |
|---|---|---|---|---|
| Z | 77.3 | 97.6 | 0.9 | 0.9 |

The nonacidic catalysts of the invention demonstrated surprisingly high efficiency for ring cleavage compared to the Example 2 acidic catalysts of the prior art.

EXAMPLE 6

The utility of the ring-cleavage step of the invention in combination with an isomerization process was examined. Two alternative feedstocks were considered in preparing yield estimates, having the following compositions in volume %:

| | Feed I | Feed II |
|---|---|---|
| Butanes | 1.5 | 1.0 |
| Isopentane | 15.0 | 10.0 |
| Normal pentane | 26.5 | 17.8 |
| Cyclopentane | 1.0 | 1.0 |
| Dimethylbutanes | 2.8 | 4.5 |
| Methylpentanes | 17.5 | 20.0 |
| Normal hexane | 17.7 | 17.7 |
| Methylcyclopentane | 7.0 | 13.0 |
| Cyclohexane | 6.0 | 9.5 |
| Benzene | 2.0 | 2.5 |
| $C_7$ | 3.0 | 3.0 |

The above compositions represent isomerization feedstocks consistent with the trend to reformulated gasoline, i.e., which contain a relatively high proportion of $C_6$ cyclics which have been diverted from reforming feedstock in order to reduce the benzene content of gasoline.

EXAMPLE 7

Yield estimates were based on isomerization with and without ring opening for each of the above feeds. Two flowschemes were considered for each case, once-through isomerization and isomerization with a fractionator to separate and recycle cyclics as in the Figure. Volumetric yields and octane numbers (RON-0=Research octane clear) are shown in order to calculate comparative "octane barrels," a measurement of the effectiveness of the isomerization operation:

| | ONCE-THROUGH | | RECYCLE | |
|---|---|---|---|---|
| | Isom Only | Ring Cleavage | Isom Only | Ring Cleavage |
| Ring Opening, % | 40 | 70 | 45 | 75 |
| Feed I: 15% Cyclics | | | | |
| Yield, vol. % | 99.5 | 100.3 | 98.4 | 98.8 |
| RON-0 | 83.4 | 82.9 | 87.2 | 87.2 |
| Yield × RON | 8298 | 8315 | 8580 | 8615 |
| Feed II: 25% Cyclics | | | | |
| Yield, vol. % | 99.0 | 100.3 | 95.2 | 99.9 |
| RON-0 | 82.2 | 81.1 | 86.8 | 87.2 |
| Yield × RON | 8138 | 8134 | 8263 | 8729 |

The process of the invention thus generally increases the production of octane-barrels from an isomerization operation. The catalyst requirement also is lower when using ring cleavage in the recycle case, by about 2% with 15% cyclics in the feed and by more than 6% with 25% cyclics in the feed.

We claim as our invention:

1. A process combination for selectively upgrading a naphtha feedstock to obtain a product having an increased isoparaffin content comprising the steps of:

(a) contacting the naphtha feedstock in a ring-cleavage zone with a nonacidic ring-cleavage catalyst, comprising at least one platinum-group metal component and a support selected from the group consisting of a nonacidic alumina, a metal-oxide solid solution and a nonacidic large-pore molecular sieve, at cleavage conditions comprising a temperature of from 100° to 550° C., pressure of from 100 kPa to 10 MPa and liquid hourly space velocity of from 0.1 to 30 $hr^{-1}$ to convert about 60% or more of the naphthenes in the feedstock by selective ring opening and produce a paraffinic intermediate; and, (b) converting the paraffinic intermediate in an isomerization zone maintained at isomerization conditions comprising a temperature of from 40° to 250° C., pressure of from 100 kPa to 10 MPa and liquid hourly space velocity of from 0.2 to 15 $hr^{-1}$ with a solid acid isomerization catalyst comprising at least one platinum-group metal component and recovering an isoparaffin-rich product.

2. The process combination of claim 1 wherein hydrogen is present in one or both of the ring-cleavage zone and the isomerization zone in an amount of from about 0.01 to 100 moles per mole of $C_5$+ hydrocarbons present in the zone.

3. The process combination of claim 2 wherein the paraffinic intermediate is transferred from the ring-cleavage zone to the isomerization zone without separation of hydrogen or light hydrocarbons.

4. The process combination of claim 1 wherein ring-cleavage selectivity to paraffins is at least about 90 mass %.

5. The process combination of claim 1 wherein the platinum-group metal component of step (a) comprises a platinum component.

6. The process combination of claim 1 wherein the support of step (a) consists essentially of a nonacidic alumina.

7. The process combination of claim 6 wherein the support comprises potassium-exchanged alumina.

8. The process combination of claim 1 wherein the support of step (a) comprises a metal-oxide solid solution.

9. The process combination of claim 1 wherein the support of step (a) comprises nonacidic L-zeolite.

10. The process combination of claim 1 wherein the ring-cleavage catalyst comprises a metal modifier selected from one or more of the group consisting of rhenium, germanium, tin, lead, gallium, indium and bismuth.

11. The process combination of claim 1 wherein the isomerization catalyst comprises a platinum-group metal component on a chlorided inorganic-oxide.

12. The process combination of claim 10 wherein the platinum-group metal component of step (b) comprises a platinum component.

13. The process combination of claim 10 wherein the isomerization catalyst comprises a Friedel-Crafts metal halide.

14. The process combination of claim 1 wherein step (a) comprises separation and recycle of a cyclics concentrate to ring cleavage and production of an isoparaffin concentrate.

15. The process combination of claim 1 further comprising blending a gasoline component comprising at least a portion of the isoparaffin-rich product.

16. A process combination for selectively upgrading a naphtha feedstock to obtain a product having an increased isoparaffin content comprising the steps of:

(a) contacting the naphtha feedstock in a ring-cleavage zone with a nonacidic ring-cleavage catalyst, comprising at least one platinum-group metal component and a support consisting essentially of a nonacidic alumina, at cleavage conditions comprising a temperature of from 100° to 550° C., pressure of from 100 kPa to 10 MPa and liquid hourly space velocity of from 0.1 to 30 $hr^{-1}$ to convert about 60% or more of the naphthenes in the feedstock by selective ring opening and produce a paraffinic intermediate; and, (b) converting the paraffinic intermediate from the ring-cleavage zone without separation of hydrogen in an isomerization zone maintained at isomerization conditions comprising a temperature of from 40° to 250° C., pressure of from 100 kPa to 10 MPa and liquid hourly space velocity of from 0.2 to 15 $hr^{-1}$ with a solid acid isomerization catalyst comprising at least one platinum-group metal component and recovering an isoparaffin-rich product.

17. A process combination for selectively upgrading a naphtha feedstock to obtain a product having an increased isoparaffin content comprising the steps of:

(a) contacting the naphtha feedstock in a ring-cleavage zone with a nonacidic ring-cleavage catalyst, comprising at least one platinum-group metal component and a support consisting essentially of a metal-oxide solid solution, at cleavage conditions comprising a temperature of from 100° to 550° C., pressure of from 100 kPa to 10 MPa and liquid hourly space velocity of from 0.1 to 30 $hr^{-1}$ to produce a paraffinic intermediate; and, (b) converting the paraffinic intermediate from the ring-cleavage zone without separation of hydrogen in an isomerization zone maintained at isomerization conditions comprising a temperature of from 40° to 250° C., pressure of from 100 kPa to 10 MPa and liquid hourly space velocity of from 0.2 to 15 $hr^{-1}$ with a solid acid isomerization catalyst comprising at least one platinum-group metal component and recovering an isoparaffin-rich product.

* * * * *